United States Patent [19]

O'Brien et al.

[11] Patent Number: 4,646,769

[45] Date of Patent: Mar. 3, 1987

[54] PRECIPITATOR CLEANING TOOL FOR FOSSIL BURNING INSTALLATION

[75] Inventors: Errol C. O'Brien, Palos Park; Martin Placko, Chicago; Wayne Breneman, Cole City, all of Ill.

[73] Assignee: J-B Industrial Corporation, Worth, Ill.

[21] Appl. No.: 732,857

[22] Filed: May 10, 1985

[51] Int. Cl.[4] ..... B08B 3/02

[52] U.S. Cl. ..... 134/199

[58] Field of Search ..... 134/199, 200, 68, 72, 134/151, 166 R, 171, 172; 68/205 R; 239/556, 560; 118/315, 316

[56] References Cited

U.S. PATENT DOCUMENTS

| | | | |
|---|---|---|---|
| 2,615,529 | 10/1952 | Lincoln | 134/172 X |
| 2,677,368 | 5/1954 | Janecek | 134/199 X |
| 2,926,674 | 3/1960 | Umbricht et al. | 134/72 |
| 3,633,651 | 1/1972 | Ruhlandt | 134/172 X |
| 3,769,993 | 11/1973 | Schaeffer | 134/172 X |
| 4,076,033 | 2/1978 | Busse et al. | 134/172 |
| 4,197,000 | 4/1980 | Blackwood | 134/199 X |
| 4,221,228 | 9/1980 | Stoffel et al. | 118/316 X |

FOREIGN PATENT DOCUMENTS

| | | | |
|---|---|---|---|
| 2821069 | 6/1979 | Fed. Rep. of Germany | 134/198 |
| 449650 | 7/1935 | United Kingdom | 134/199 |
| 391870 | 12/1973 | U.S.S.R. | 134/151 |

*Primary Examiner*—Philip R. Coe

[57] ABSTRACT

A cleaning tool for removing deposits from plural surfaces, such as the precipitator plates and wires and the like of coal burning electrical power plants or other fossil fuel combustion systems. The tool includes multiple jets which deliver high pressure streams of water or other liquid in opposite directions for simultaneous cleaning of parallel surfaces. One or more jets are also provided for spraying in a direction perpendicular to the direction of the sprays of the multiple jets for removing deposits from the wires disposed between the surfaces. The tool is coupled to a high pressure fluid source and may be lowered or raised between the plates for effective cleaning.

5 Claims, 4 Drawing Figures

4
6
7
6
7
6
6
5a
10
26b
8
2
26a
5a
5a
5
5
5

PRECIPITATOR CLEANING TOOL FOR FOSSIL BURNING INSTALLATION

BACKGROUND OF THE INVENTION

This invention relates in general to spray cleaning systems and, in particular, to a high pressure fluid system for removing deposits from surfaces of plates, wires, or other structures and elements.

More specifically, but without restriction to the particular use which is shown and described, this invention relates to a precipitator cleaning tool by which inaccessible surfaces and elements may be effectively and quickly cleaned through the use of high pressure sprays. The invention of the application is particularly intended to remove ash and other deposits from the precipitator plates and wires commonly used in electrical power plants and other combustion systems of the coal burning type. The precipitator cleaning tool herein disclosed provides a multi-direction spray capability for the simultaneous cleaning of opposed surface areas and intermediate components, such as electrical wires and the like.

As is well known, many electrical generating stations use fossil fuel as the energy source for producing electricity. As a result of the operation of the fossil fuel plant, a buildup of deposits occurs on the interior walls of the power plant, such as in the cyclone burner and exhaust system. One common technique for removing the adhering material on a periodic basis, among others, uses a pressure spray system to physically dislodge the buildup from interior surfaces.

As required by the Environmental Protection Agency, fossil fuel power plants commonly rely on a plurality of spaced precipitator plates to remove ash and other pollutants produced in the combustion process in the generating station. Normally, a plurality of precipitator plates are used in a power station, each separated by a distance, such as approximately nine inches. Because of their close spacing and large size, i.e. 25–35 feet in length, present cleaning techniques for hydroblasting ash and other material deposited on the precipitator plates have been unsatisfactory. The problem in cleaning precipitators is compounded by the presence of a series of electrical wires extending between the parallel plates. The electrical wires create an electrical field in the precipitator and also collect a deposit of ash or material during operation.

Removal of ash deposits on precipitator plates and wires has in the past been accomplished by rappers or, in case of heavy deposits, by hydroblasting using lances of different lengths dependent on plate size. Because of limited access, even hydroblasting has not been an effective manner of cleaning the structure. The previously slow procedure of cleaning the precipitator with conventional equipment, moreover, must be repeated for areas between each pair of the numerous plates.

Because of the shortcomings of known equipment, the shutdown time of a generating station is greatly increased in part by the slowness and tedious step of cleaning the precipitator. Any delay of the power plant in returing to service because of cleaning shutdowns results in considerable loss of revenue to the electrical utility and an increase of cost of energy to the consumer. By cleaning the precipitator with greater speed and efficiency, such costs to the utility and consumer can be reduced.

SUMMARY OF THE INVENTION

It is therefore an object of this invention to improve the removal of deposits from combustion exposed surfaces of an electrical power plant using fossil fuel and the like.

Another object of this invention is to provide a cleaning tool capable of removing deposits from spaced surfaces on a simultaneous basis.

A further object of this invention is to provide a cleaning tool capable of delivering high pressure fluid against opposed surfaces on a simultaneous basis.

Still another object of this invention is to provide a precipitator tool capable of cleaning elements positioned between opposed surfaces during the cleaning thereof.

Still another obJect of this invention is to provide a cleaning tool capable of increased efficiency in removing ash deposits and the like present on precipitator plates and wires of an electrical power plant.

These and other objects are attained in accordance with the present invention wherein there is provided an improved precipitator plate cleaning tool. The tool herein disclosed is capable of being easily and efficiently positioned between opposed surfaces of parallel precipitator plates and the like of electrical power plants and other fossil fuel burning systems. The tool of the invention delivers high pressure sprays in opposite directions through a plurality of nozzles for simultaneously cleaning opposed areas of confronting surfaces of spaced plates or other structures. In addition, one or more nozzles are directed in a perpendicular direction to the surface sprays for the purpose of removing ash deposits present on the electrical wires or other components situated between the precipitator plates. The precipitator wires are thus subjected to cleaning, while the tool is being moved between the plates.

The improved design of the precipitator cleaning tool of the invention increases the speed and ease by which precipitator plates of power plants or other facilities can be cleaned. Such efficiency reduces the overall cost of cleaning a generating station and reduces the shutdown time of the utility. The tool of the invention is further capable of increased effectiveness of removing deposits from closely spaced parallel plates than prior designs, since it provides a more direct impact of high pressure blasts against the surface areas being cleaned.

DESCRIPTION OF THE DRAWINGS

Further objects of the invention, together with additional features contributing thereto and accruing therefrom, will be apparent from the following description of the preferred embodiment of the invention which is shown in accompanying drawings, with like reference numerals indicating corresponding parts throughout wherein.

DESCRIPTION OF A PREFERRED EMBODIMENT

Figure 2:
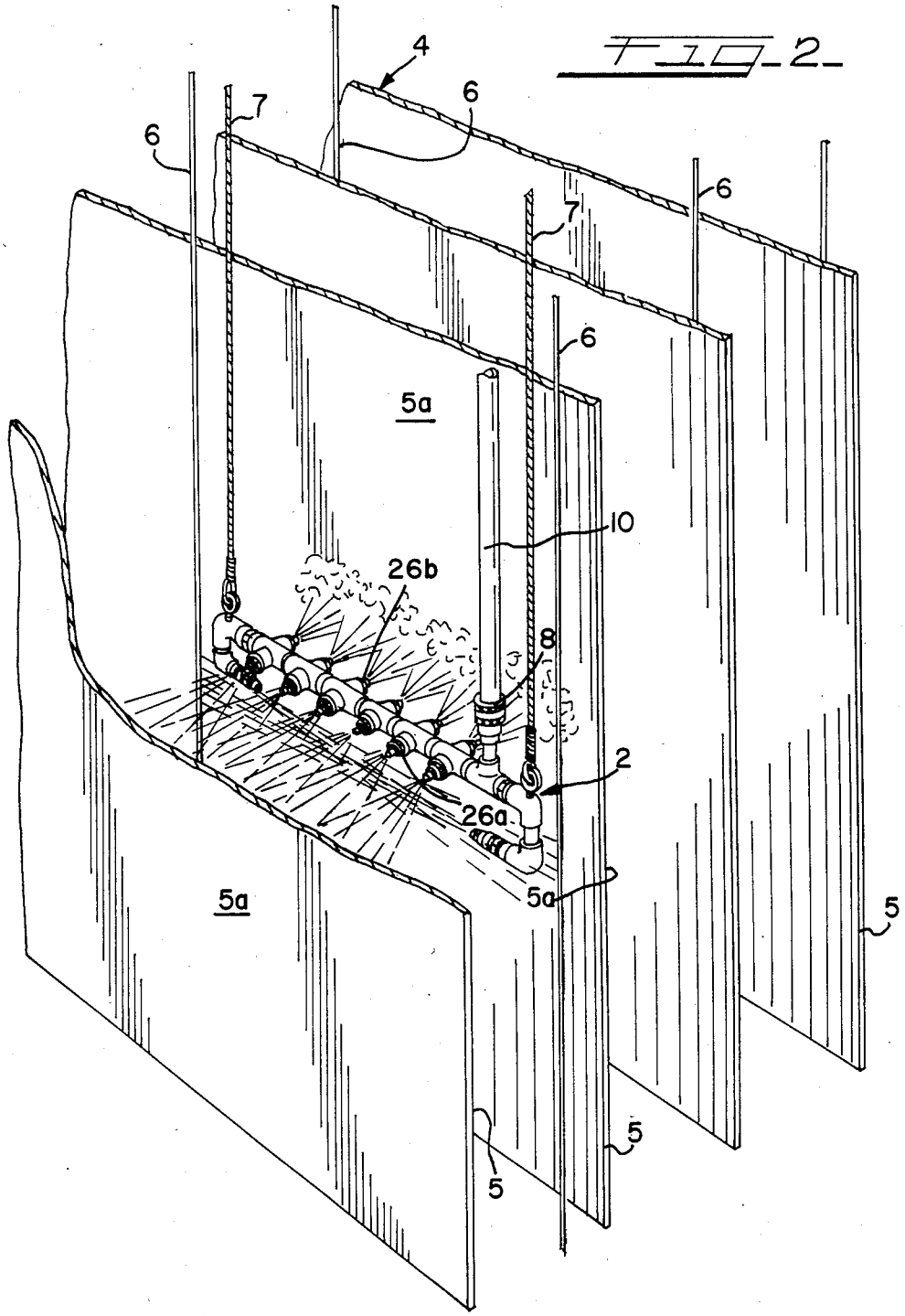
FIG. 2 is a perspective view of the precipitator tool of the invention positioned between plates of an electrical power plant and performing a deposit removing function through multiple sprays of high pressure.

Referring now to FIG. 2, there is illustrated the precipitator cleaning tool of the invention generally designated by reference numeral 2 and intended for cleaning surfaces, such as present in the precipitator device 4 of an electrical generating station or other facility powered by a fossil fuel.

Figure 1:
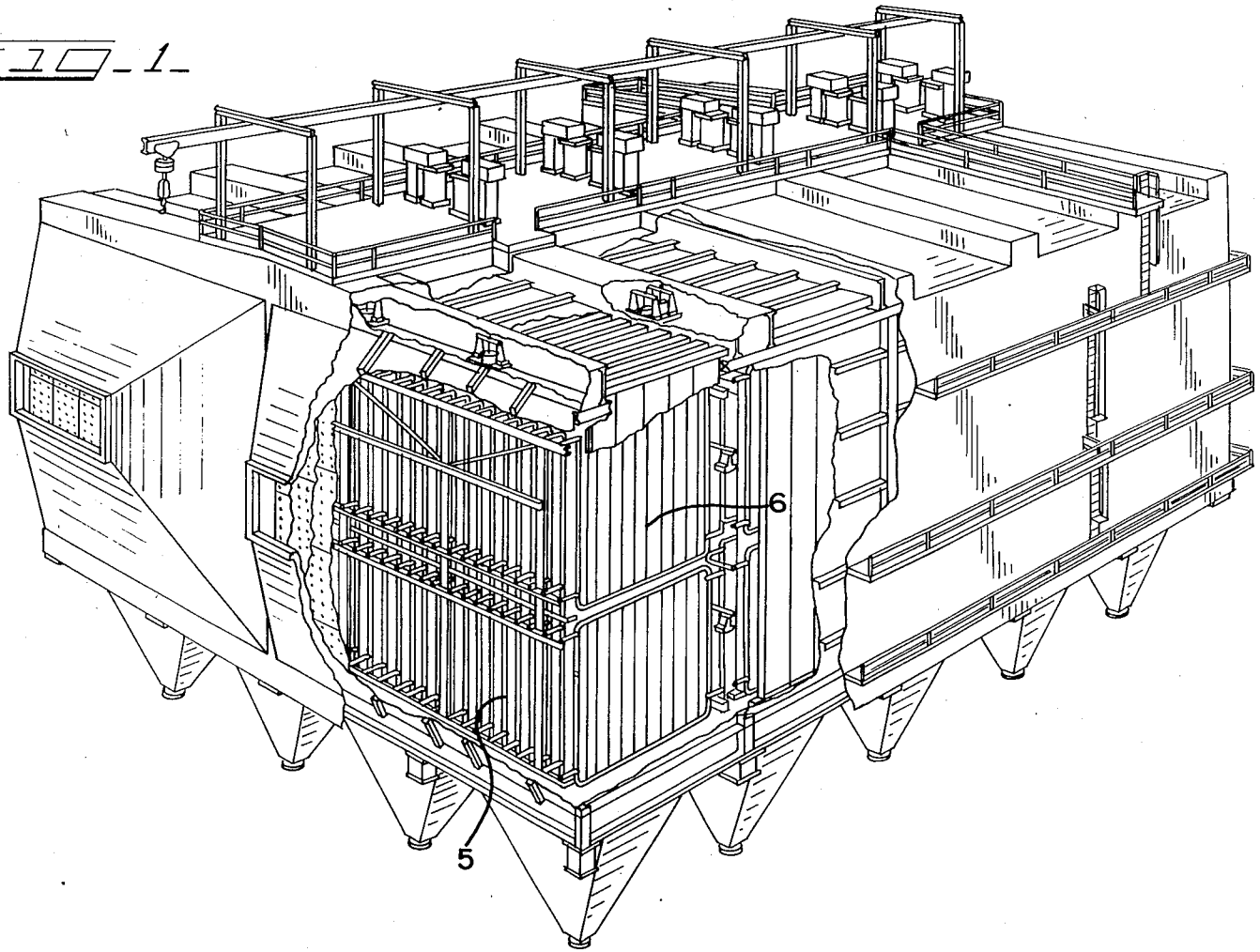
FIG. 1 is a perspective view of a typical electrostatic precipitator used in fossil burning power plants for environmental control which may be cleaned by the precipitator tool of the invention.

In FIG. 1, a typical electrostatic precipitator having a plurality of plates 5 and wires 6 is shown as one example of a system that can be cleaned by the invention. A precipitator, such as illustrated in FIG. 1 and many other designs for precipitators (not shown), are extremely difficult to clean because of the close spacing of the very large plates. In environmental pollution control, precipitator 4 performs the function of removing polluting material, such as ash and the like, which is generated in the combustion process. The plurality of precipitator plates 5 have a length of approximately 25–35 feet, and a close spacing, i.e. 9 inches between each adjacent pair. A number of electrical wires 6 extend vertically at the approximate midpoint or other suitable position in the space between adjacent plates 5. The wires 6 cause the pollutants passing between the plates 5 to precipitate out and adhere to plate surfaces 5*a* through creation of an electrical field by a standard technique. As the material in the form of ash and other deposits adheres to the surfaces 5*a* of plates 5 and wires 6, the ash and the like must be routinely removed in order that the precipitator 4 may function in a proper manner to reduce pollutants introduced into the atmosphere.

Figures 3, 4:
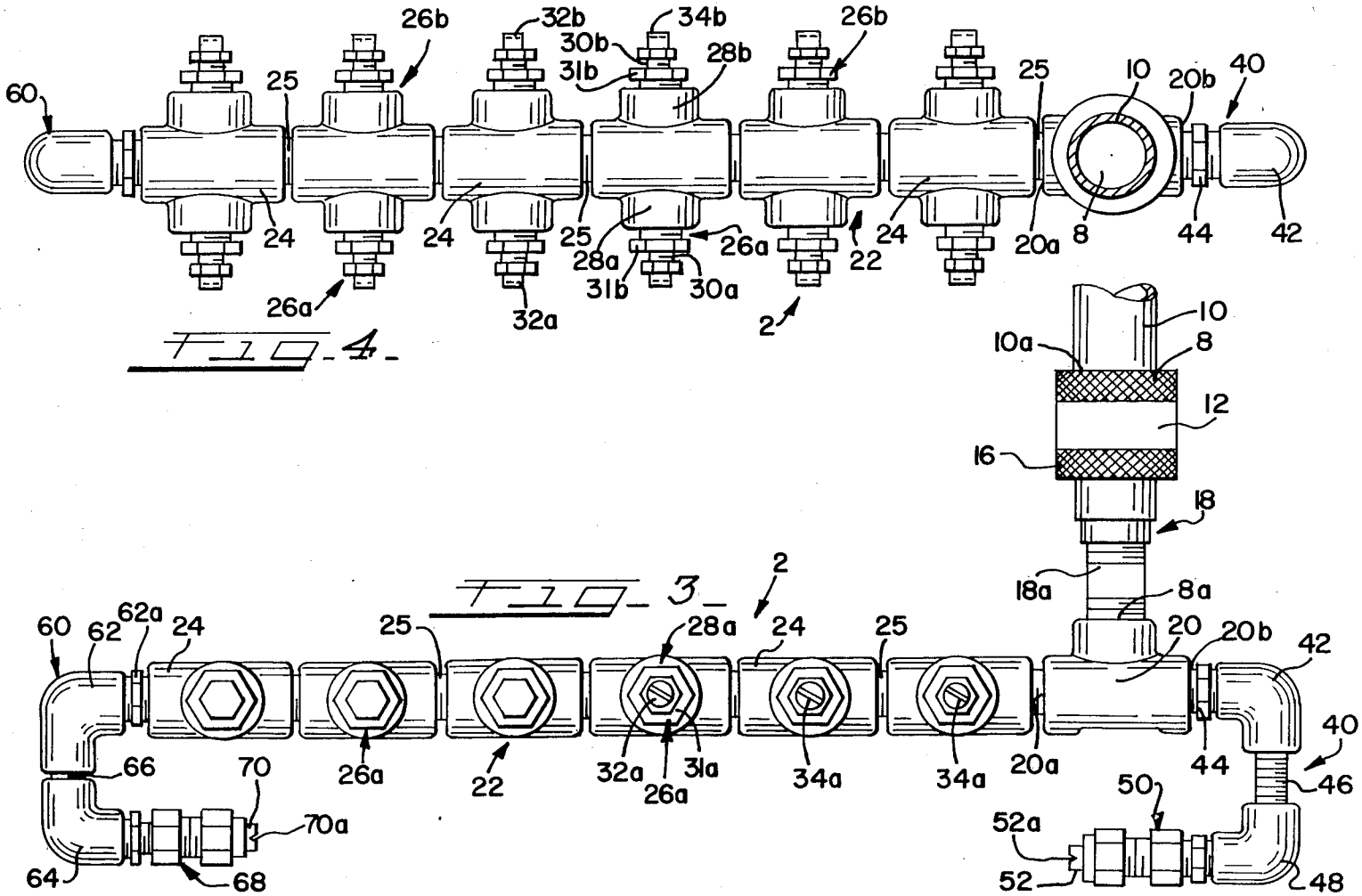
FIG. 3 is a side schematic view of the precipitator tool of the invention.
FIG. 4 is a top schematic view of the precipitator cleaning tool of the invention.

In FIG. 2, the precipitator cleaning tool 2 of the invention is shown in operative position between adjacent precipitator plates 5. The precipitator cleaning tool 2 may be lowered or raised between the opposing plates 5 and manipulated by an operator until the surface areas on each pair of plates 5 and on the precipitator wires 6 therebetween are subjected to streams of high pressure liquid sprays. Although other lower techniques may be employed in FIG. 2, a pair of cables 7 affixed by brackets 7′ to precipitator device 2 are used to lower the tool between plates 5. The cables 7 may be controlled by any suitable mechanism or manually in a manner that the tool maintains a generally horizontal orientation. As seen in FIGS. 2 and 3, the precipitator cleaning tool 2 includes an inlet 8 to which the end of a hose 10 from a high pressure source of water and the like is supplied from a suitable pumping apparatus (not shown). Generally, the tool of the invention is intended to operate at pressures of 4,000 to 6,000 psi or more in order to dislodge and remove the material adhering to the surfaces 5*a* of the precipitator plates 5 and to the wires 6. The outlet end 10*a* of the hose 10 is affixed to the inlet 8 by a conventional coupler 12 having internal threaded elements (not shown) for a fluid tight connection. The surface of the coupler 12 is provided with serrated areas 16 to facilitate quick connect/disconnect operations.

The coupler 12 is connected to a hollow conduit 18 having an end fitting 18*a* to create an inlet to a tool housing 20 in the form of a T-connection. The housing 20 is provided with an inlet 8*a* and an outlet 20*a* which is coupled to a hollow manifold 22. The manifold 22 comprises a series of fluid conduit sections 24 interconnected by threaded pipe sections 26 to form a continuous interior flow passage or conduit throughout the length of manifold 22. Although any number of sections may be employed with the invention of the application, a series of six pipe sections 25 are shown, each having oppositely disposed nozzle assemblies 26*a*, 26*b*. The nozzle assemblies 26*a*, 26*b* extend outwardly on both sides of the precipitator tool 2 and are in fluid communication with the interior of the pipe sections 24 by means of reducer sections 28*a*, 28*b* which are threaded to outlets through respective sides of each pipe section 24. Coupling assemblies 30*a*, 30*b*, having a hex bushing 31*a*, 31*b*, project outward from reducer sections 28*a* and 28*b* and terminate with nozzle elements 32*a*, 32*b*, projecting in opposite directions in spaced relationship along the longitudinal axis of the manifold 22. An elongated nozzle opening 34*a*, 34*b* is provided on each nozzle having an elongated axis sloped with relation to the longitudinal axis of the manifold 22 and is designed to produce a spray of any angular extent or spray form, such as 45°, as shown in FIG. 2, in a manner that the sprays from respective adjacent nozzles 32*a*, 32*b* overlap each other. Advantageously, the sprays in opposite directions are balanced in force to insure stability and positioning as the precipitator tool is positioned between the plates 6.

Although the manifold 22 is shown in FIGS. 2–4 as being formed by separate sections to form a unitary body, it is within the scope of the invention to use a single hollow manifold having a plurality of exterior nozzles accomplishing a similar spraying action for simultaneous cleaning as shown.

The T-housing 20 has a second outlet 20*b* for introducing pressure from the inlet 8*a* to a wire cleaning coupler nozzle assembly 40. The wire cleaning nozzle assembly 40 includes an angle pipe section 42 which is connected to the housing 20 by coupler 44. A conduit 46 interconnects the angle pipe section 42 to an outer hollow angle pipe section 48. The end of the outer section 48 includes a coupler and reducing section 50 on which a nozzle 52 having an outlet 52*a* is mounted. The foregoing elements of the nozzle assembly 40 provide a continuous fluid passage between outlet 20*b* and nozzle opening 52*a*. The nozzle opening 52*a* is capable of delivering a lateral spray having a spray extent of an angle of approximately 45° inwardly, and approximately perpendicular and across the directions of the sprays created by nozzles 32*a*, 32*b*. For superior results, the lateral spray may be aimed along an axis either beneath or above the longitudinal axis of the manifold 22, dependent on whether the tool is being raised or lowered between the plates 5.

The other end of the manifold 22 of precipitator cleaning tool 2 is provided with a second wire cleaning nozzle assembly 60 disposed in fluid communication to the opposite end pipe section 24. The second wire cleaning section 60 includes an angle pipe 62 interconnected to the manifold 22 by means of a coupler system 62*a*. A second angle pipe 64 is interconnected to the pipe 62 by coupler 66 and receives pressurized fluid for delivery to a nozzle reducing and coupling assembly 68 upon which a nozzle 70, having a nozzle opening 70*a*, is affixed. The nozzle 70 also directs a spray of approximately 45° across the sprays from nozzle element 32*a*, 32*b*, along a direction opposite to, but offset from, the axis or direction of spray of nozzle 52. Accordingly, the offset nature of the sprays of the lateral wire cleaning nozzles insure that any wires 6 disposed between the precipitator plates 5 are cleaned during positioning and manipulation of the tool 2 between the precipitator plates.

From the foregoing, it should be apparent that, as the tool is moved by an operator through manual manipulation upward and downward and across the spaced plate surfaces in a cleaning action, the cleaning tool 2 of the invention is capable of simultaneously removing deposits, such as ash and the like, from both plate surfaces 5*a*, while at the same time, removing ash from the wires 6. Accordingly, the tool of the invention attains the cleaning of inaccessible surfaces and parts of power plants and other facilities with ease and increased efficiency by an operator.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A spray cleaning tool for simultaneously cleaning opposed surfaces of a pair of spaced-apart plate members and intermediate elements disposed between said pair of plate members comprising a hollow manifold arranged to be coupled to a source of high pressure liquid and to be raised and lowered between said pair of plate members;

said manifold having a plurality of nozzles arranged along the length of said manifold and directed in opposite directions for simultaneous spraying said opposed surfaces of said pair of said spaced-apart plate members for the removal of material therefrom; and a pair of fluid conduits in fluid communication with said hollow manifold and respectively being positioned perpendicular to said manifold at opposite ends thereof, each of said conduits having a nozzle spaced from said manifold and positioned for directing sprays towards one another perpendicular to the directions of said sprays of said plurality of nozzles of said hollow manifold, said sprays from said manifold nozzles acting to clean the surfaces of said pair of spaced plates and said sprays from said conduit nozzles acting to clean said intermediate elements substantially without interference with one another, whereby the opposed surfaces of the pair of spaced-apart plate members and the intermediate elements disposed therebetween can be cleaned simultaneously.

2. The cleaning tool of claim 1 wherein said directions of spray of said two nozzles of said conduits are spaced outward in parallel relationship to said length of said manifold.

3. The spray cleaning tool of claim 1 wherein said nozzles of said fluid conduits have nozzle openings for directing sprays towards each other along offset axes, said axes of said sprays of said nozzles of said conduits being disposed between the plurality of the nozzles arranged along the length of said manifold and directed in opposite directions.

4. A cleaning tool for directing fluid sprays in multiple directions comprising manifold means having an interior conduit extending along an axis and an inlet thereto, said inlet being arranged to be coupled to a high pressure source supplying fluid to said interior conduit;

support means for supporting said manifold means between confronting spaced surfaces, a plurality of nozzles coupled to each side of said manifold means;

said plurality of nozzles delivering high pressure sprays in substantially opposite directions from said manifold means for simultaneously cleaning areas of said confronting spaced surfaces, coupler means perpendicularly connected to said manifold means at each of the opposite ends thereof and having inwardly directed nozzle means affixed thereto, said inwardly directed nozzle means directing fluid sprays in a generally angular relationship to the directions of the fluid sprays of said nozzle means of said manifold means at a position to avoid interaction with said high pressure sprays, said nozzle means of said coupler means having a pair of spaced nozzles respectively positioned in projecting relationship from said manifold means in fluid communication with said interior conduit, said spaced nozzles arranged to direct high pressure sprays toward each other in a direction substantially parallel to said axis of said interior conduit between said plurality of nozzles on each side of said manifold means; and said high pressure sprays of said pair of spaced nozzles being directed against wire elements disposed between said spaced surfaces for simultaneously cleaning the wire elements.

5. The cleaning tool of claim 4 wherein each of said plurality of nozles direct a spray having approximately a 45° divergence from a respective nozzle to overlap an adjacent spray.

* * * * *